US008690663B2

(12) United States Patent
Saffari et al.

(10) Patent No.: US 8,690,663 B2
(45) Date of Patent: Apr. 8, 2014

(54) PAYLINE AND WAGERING OPTIONS FOR LOW DENOMINATION GAMES

(75) Inventors: Ali M. Saffari, Reno, NV (US); John W. Chamberlain, Carson City, NV (US); Anisur R. Chowdhury, Reno, NV (US); Christopher T. Lundy, Reno, NV (US); James A. Vasquez, Carson City, NV (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 1167 days.

(21) Appl. No.: 11/035,270

(22) Filed: Jan. 12, 2005

(65) Prior Publication Data

US 2006/0154723 A1 Jul. 13, 2006

(51) Int. Cl.
*A63F 9/00* (2006.01)

(52) U.S. Cl.
USPC ..... 463/25

(58) Field of Classification Search
USPC ..... 463/25, 17, 16, 9; 703/35
See application file for complete search history.

(56) References Cited

U.S. PATENT DOCUMENTS

| | | | | |
|---|---|---|---|---|
| 6,068,552 | A | 5/2000 | Walker et al. | |
| 6,186,894 | B1 * | 2/2001 | Mayeroff | 463/20 |
| 6,368,214 | B1 * | 4/2002 | Luciano | 463/18 |
| 6,805,630 | B2 | 10/2004 | Rubeli | |
| 7,018,293 | B2 * | 3/2006 | Brown et al. | 463/20 |
| 7,025,675 | B2 * | 4/2006 | Fogel et al. | 463/9 |
| 7,089,202 | B1 * | 8/2006 | McNamar et al. | 705/35 |
| 7,144,322 | B2 * | 12/2006 | Gomez et al. | 463/20 |
| 2002/0045476 | A1 * | 4/2002 | Poole et al. | 463/25 |
| 2002/0058545 | A1 * | 5/2002 | Luciano | 463/18 |
| 2002/0077171 | A1 | 6/2002 | Ainsworth | |
| 2002/0132660 | A1 * | 9/2002 | Taylor | 463/16 |
| 2002/0142830 | A1 * | 10/2002 | Adams | 463/20 |
| 2002/0151366 | A1 | 10/2002 | Walker et al. | |
| 2003/0036419 | A1 * | 2/2003 | Baerlocher et al. | 463/16 |
| 2003/0050111 | A1 * | 3/2003 | Saffari | 463/25 |

(Continued)

FOREIGN PATENT DOCUMENTS

| | | |
|---|---|---|
| EP | 1396829 A2 | 3/2004 |
| EP | 1482459 A3 | 8/2005 |
| EP | 1396829 A3 | 9/2005 |

OTHER PUBLICATIONS

"Search and Examination Report" from Corresponding Foreign Application No. GB0600371.9, Jun. 14, 2006, 6 pages.

(Continued)

*Primary Examiner* — Seng H Lim
(74) *Attorney, Agent, or Firm* — Foley & Lardner LLP

(57) ABSTRACT

Methods and systems for providing low denomination payline and wagering options for "penny" gaming machines and systems are disclosed. A gaming machine or system configurator can provide various operator adjustable settings, including minimum overall wager, maximum overall wager, available denominations for play, minimum number of paylines that must be played, and incremental amount of paylines to be played. The configurator can include manual devices, an interface to a remote server or internal gaming machine logic. Player adjustable game parameters can include a play denomination, an overall wager, the number of paylines played and the number of credits per payline. Parameters not set by the player are automatically calculated by the gaming machine for faster game play. Residual awards or credit balances of less than a whole coin can be squared by payout mechanisms including a ticket printer, a player accounting system, a charity feature or a bonus play feature.

2 Claims, 7 Drawing Sheets

(56) References Cited

U.S. PATENT DOCUMENTS

| | | | | |
|---|---|---|---|---|
| 2003/0050117 | A1* | 3/2003 | Silva et al. | 463/36 |
| 2003/0060266 | A1* | 3/2003 | Baerlocher | 463/20 |
| 2003/0064771 | A1* | 4/2003 | Morrow et al. | 463/16 |
| 2003/0069068 | A1* | 4/2003 | Kaminkow | 463/25 |
| 2003/0092482 | A1* | 5/2003 | Meyer | 463/20 |
| 2003/0100356 | A1* | 5/2003 | Brown et al. | 463/9 |
| 2003/0114215 | A1 | 6/2003 | Adams et al. | |
| 2003/0216165 | A1* | 11/2003 | Singer et al. | 463/20 |
| 2004/0043809 | A1* | 3/2004 | Gomez et al. | 463/16 |
| 2005/0049037 | A1* | 3/2005 | Anderson et al. | 463/25 |
| 2005/0143166 | A1* | 6/2005 | Walker et al. | 463/25 |
| 2005/0282607 | A1 | 12/2005 | Gauselmann | |
| 2006/0063583 | A1* | 3/2006 | Thomas | 463/20 |
| 2006/0068898 | A1 | 3/2006 | Maya | |
| 2006/0073889 | A1* | 4/2006 | Edidin et al. | 463/27 |
| 2006/0079310 | A1 | 4/2006 | Friedman et al. | |
| 2006/0178206 | A1* | 8/2006 | Kraft et al. | 463/25 |
| 2007/0032288 | A1 | 2/2007 | Nelson et al. | |
| 2008/0058086 | A1 | 3/2008 | Saffari et al. | |

OTHER PUBLICATIONS

"Examination Report" from Corresponding Foreign Application No. GB0600371.9, Apr. 18, 2007, 3 pages.

Examination Report Under Section 18(3) from corresponding United Kingdom Patent Application No. GB0600371.9 dated Jun. 18, 2008, 7 pages.

Examination Report Under Sections 17 and 18(3) from corresponding United Kingdom Patent Application No. GB0718556.4 dated Nov. 19, 2007, 4 pages.

Examination Report from corresponding United Kingdom patent application No. GB0600371.9, dated Sep. 12, 2007, 6 pages.

Examination Report Under Section 18(3) from corresponding United Kingdom Patent Application No. GB0718556.4 dated Sep. 16, 2008.

Examination Report Under Section 18(3) from corresponding United Kingdom Patent Application No. GB0600371.9 dated Feb. 26, 2009, 3 pages.

Australian Examination Report dated Jul. 21, 2010 issued in 2006200115.

U.S. Office Action dated Jan. 20, 2011 issued in U.S. Appl. No. 11/929,509.

Australian Second Examination Report dated Apr. 21, 2011 in 2006200115.

Australian Third Examination Report dated Aug. 15, 2011 in 2006200115.

Australian Fourth Examination Report dated Nov. 3, 2011 in 2006200115.

Australian Fifth Examination Report dated Jan. 23, 2012 in 2006200115.

* cited by examiner

PAYLINE AND WAGERING OPTIONS FOR LOW DENOMINATION GAMES

TECHNICAL FIELD

The present invention relates generally to gaming machines and systems, and more specifically to wagering options in gaming machines and systems.

BACKGROUND

"Penny" slots and gaming machines are becoming increasingly popular with casinos and players alike, as many are finding increased excitement and value in the ability to win jackpots of thousands of credits without risking large sums of money to do so. As in the case of many gaming machines, such as slot machines, video poker machines, video keno machines or the like, a game play at a penny or other low denomination gaming machine is usually initiated through a player wager of money or credit, whereupon the gaming machine determines a game outcome, presents the game outcome to the player and then potentially dispenses an award of some type, including a monetary award, depending upon the game outcome. As is generally known, modern penny and other low denomination gaming machines tend to be electronic or microprocessor based, as in the case of many modern gaming machines, and typically have a central processing unit ("CPU") or master gaming controller ("MGC") that controls various combinations of hardware and software devices and components that encourage game play, allow a player to play a game on the gaming machine and control payouts and other awards.

Although increasing in popularity, low denomination gaming machines do tend to have some drawbacks, particularly with respect to the casino or gaming operator. For example, while many low denomination or "penny" gaming machines permit players to select from a variety of play options and parameters, it is usually possible to play a single penny, small coin or other form of credit on a single payline. Unfortunately, providing floor space, overhead and gaming machines where it is possible for a player to make repeated bets of 1¢ or thereabouts per play is typically an unprofitable situation for many gaming operators. While many players do choose to wager dozens or hundreds of pennies or credits per play, there are those who do not, perhaps wishing to take advantage of a warm seat, free alcohol, and/or other casino amenities traditionally provided to players. Not only does the gaming operator typically lose money on such players, but these single or low credit players also take seats at gaming machines that might otherwise be used by more active players, particularly during periods of high casino activity. Compounding this problem is the fact that some of the newer low denomination gaming machines are even being designed to allow wagers of a fraction of a small denomination coin, such as a half penny. For example, Aristocrat of Australia is known to be producing such low denomination gaming machines. Other concerns may arise with respect to such games, such as how to pay out a fraction of a coin or how to permit players to bet in fractional increments.

Another inconvenience to casinos and other gaming operators involves the limited ability to alter gaming machine settings or parameters based upon unique or changing conditions. For example, while many gaming machines, and penny machines in particular, permit the play of a slots style game across multiple paylines, there are typically restrictions on the number of paylines that can or must be played. One example of such a gaming machine is the "By George" gaming machine made and sold by IGT of Reno, Nev. The By George gaming machine requires that a player play all ten available paylines for every play at the gaming machine, regardless of denomination or amount wagered. This is simply a feature of game play that is required and cannot be adjusted by the gaming operator, the player, or anyone else for these particular gaming machines. Although this feature is prominently displayed and advertised as a positive item for these By George gaming machines, some players might not desire to play so many paylines, while others may desire to play even more. Unfortunately, gaming operators that might desire to accommodate such demands are not able to adjust the parameters of this particular machine.

In fact, it is typical of many gaming machines that there is little to no flexibility with respect to limits that can be set by the casino or other gaming machine operator. For example, many other types and themes of gaming machines can similarly offer the same fixed number of maximum credits per payline and the same fixed number of paylines regardless of the denomination of play. In some gaming jurisdictions that have wagering limits, this tends to limit both the number of paylines and the maximum credits per payline according to the maximum denomination. For example, in the state of Washington, the maximum allowable wager is $5.00. If the maximum denomination on a given gaming machine is 5¢ (i.e., a nickel), then a total of 100 paylines for a maximum wager of $5.00 is allowable. Conversely, where the maximum denomination is 25¢ (i.e., a quarter), then only 20 paylines could be made available for the same overall bet of $5.00.

Furthermore, low denomination gaming machines in particular can be very time consuming. Typically, there can be requirements for players to input many coins and also make many game selections and other inputs for every game that is played. These things all take time, however, which is something that tends to be frowned upon at many gaming establishments. It is generally known that the number of games played per minute at a given gaming machine is an important statistic within the gaming industry, particularly during prime gaming hours, such that features that require additional inputs and delays for every play at a gaming machine are generally disfavored. Thus, many casinos and other gaming operators also tend to want to expedite game play by having fewer options available to players. Where penny games and other low denomination gaming machines are concerned, however, such time consuming complexities are generally understood to be part of such machines.

While existing systems and methods for providing payline and wagering options in low denomination gaming machines and systems have been adequate in the past, improvements are usually welcomed and encouraged. In light of the foregoing, it is desirable to develop gaming machines and systems that permit more flexibility for gaming operators and more streamlined play for players, and in particular for such gaming machines and systems to provide a variety of limits, settings and automated calculations that expedite game play for a more enjoyable overall gaming experience.

SUMMARY

It is an advantage of the present invention to provide improved payline and wagering options for low denomination gaming machines and systems. This is accomplished in many embodiments by providing within or about a gaming machine or system a configurator that allows a gaming machine or system operator to change various adjustable gaming machine settings as desired. Such operator adjustable settings can relate to various aspects and limits for multiple payline games at low denominations, such that players can be prevented from wagering a small coin or fraction of a coin on a single payline or play. Other advantages include increased rates of game play and player conveniences resulting from automated calculations that take the place of ordinarily time consuming manual player inputs.

According to several embodiments of the present invention, the disclosed systems and methods involve a gaming machine and/or gaming system adapted for accepting a wager, playing a game based on the wager and granting a payout based on the result of the game. The gaming machine or system can include an MGC adapted to control one or more game aspects, as well as various associated input devices and display devices adapted to accept input and display information regarding placements of wagers and plays of games based on the wagers. Such devices can include various buttons, touch screens, speakers and the like. In embodiments including an actual gaming machine, a gaming machine exterior housing arranged to contain a plurality of internal gaming machine components can also be included. In embodiments to a gaming system, a terminal adapted for game play by a player can be included, which terminal can be a gaming machine.

In addition, at least one configuration device or configurator can be included to facilitate the provision of a plurality of operator adjustable settings to an operator of the gaming machine or gaming system. Such operator adjustable settings can include those for a minimum overall wager and a maximum overall wager that can be placed by a player to play a game at the gaming machine or terminal. Both the minimum and maximum overall wagers, as well as any overall wager, can be a multiple of a selected denomination of play. Players may also be permitted to select an overall wager at a range from the set minimum to the set maximum, if any, where the overall wager is generally the sum of all wagers across all paylines for a given play. Other operator adjustable settings can also include available denominations of play, a minimum number of paylines to be played, and an incremental value to the player selectable number of paylines to be played, among others.

Actual implementations of the configuration devices or configurators can include one or more manual devices, such as a button, knob, dial, switch, keyboard and/or graphical user interface, as well as an interface to a remotely located server in communication with the gaming machine or terminal. Such a remotely located server could also be adapted to make desired changes electronically. In addition, a gaming machine configurator can include internal logic within the gaming machine itself, such as at the MGC or an associated MGC storage device. In the event that internal logic is used at a remote server or within the gaming machine itself, such internal logic can be adapted to reconfigure one or more of the operator adjustable settings automatically in response to a triggering event. Such triggering events can include a specific date, specific time and a threshold level of recent inactivity at said gaming machine, among other items.

In some embodiments, the gaming machine or system can include at least one payout mechanism adapted to provide an overall winning or credit amount, where such a winning or credit amount includes a residual portion. Such a residual portion can be a tiny or fractional amount, and might require the use of multiple coins of differing denominations in the event that actual currency is provided to the player. Such a payout mechanism can include a ticket printer adapted to issue printed tickets, a player tracking device adapted to record the residual portion to a player account for use at a later time, a charity feature adapted to permit the player to donate the residual portion, and a bonus play feature adapted to permit the player to wager the residual portion for a bonus game play as an exception to the minimum overall wager.

According to various detailed embodiments of the present invention, a plurality of play denominations can be made available to the player, with such available denominations including at least one having a value of exactly or less than the smallest common coin of a currency local to the gaming machine. In a particular embodiment, such small play denominations can include those 1¢, ½¢, ⅕¢ and/or 1/10¢ games. Players may also be permitted to select various other game parameters within the adjustable limits set by the gaming machine operator. Such additional player selectable parameters within the operator set limits include an overall wager for a game, the number of paylines to be played and the amount of money or number of credits to be wagered per payline, among others.

The gaming machine or system can also include an automated game preparation component adapted to accept one or more game parameter inputs from a player and to provide automatically further game parameters based upon the player selected game parameter inputs. In particular, a player can select or acquiesce in a default denomination setting, and then make an affirmative choice as to what the overall wager will be for a game, whereupon the gaming machine or system can then automatically determine the number of paylines to be played and the number of credits to be wagered per payline. An additional player activation or initiation of the game may then be necessary, if desired.

In further embodiments of the present invention, various methods of administering games at a gaming machine or gaming terminal within a gaming system are provided. A first step involves providing a gaming machine or system having an MGC and a configurator adapted to facilitate the provision of operator adjustable settings to a gaming machine operator, such as a casino, reservation, riverboat or other gaming establishment. Other steps can include adjusting at least one operator adjustable setting, such as one of those noted above, and offering to a player of the gaming machine or terminal an option to change a game parameter, such as one of those noted above. Additional steps might also include accepting an input from the player regarding a change to a game parameter, calculating automatically an appropriate value for each of a set of remaining game parameters, receiving another input from the player regarding initiation of a game play based on the accepted and automatically calculated game parameters, playing a game based on such parameters, and granting a monetary award to the player based on the game result. Further process steps might also involve accepting yet another input from the player regarding further changes to a game parameter, and then recalculating automatically an appropriate value for each of the remaining game parameters.

Other methods, features and advantages of the invention will be or will become apparent to one with skill in the art upon examination of the following figures and detailed description. It is intended that all such additional methods, features and advantages be included within this description, be within the scope of the invention, and be protected by the accompanying claims.

BRIEF DESCRIPTION OF THE DRAWINGS

The included drawings are for illustrative purposes and serve only to provide examples of possible structures and process steps for the disclosed inventive payline and wagering options in low denomination gaming machines and systems. These drawings in no way limit any changes in form and detail that may be made to the invention by one skilled in the art without departing from the spirit and scope of the invention.

DETAILED DESCRIPTION

Exemplary applications of systems and methods according to the present invention are described in this section. These examples are being provided solely to add context and aid in the understanding of the invention. It will thus be apparent to one skilled in the art that the present invention may be practiced without some or all of these specific details. In other instances, well known process steps have not been described in detail in order to avoid unnecessarily obscuring the present invention. Other applications are possible, such that the following example should not be taken as definitive or limiting either in scope or setting. In the detailed description that follows, references are made to the accompanying drawings, which form a part of the description and in which are shown, by way of illustration, specific embodiments of the present invention. Although these embodiments are described in sufficient detail to enable one skilled in the art to practice the invention, it is understood that these examples are not limiting, such that other embodiments may be used and changes may be made without departing from the spirit and scope of the invention.

One advantage of the present invention is the introduction of gaming machines and systems that provide improved payline and wagering options for low denomination games. This is accomplished in part by providing a configurator that allows a gaming machine or system operator to change various adjustable gaming machine settings as desired. Such operator adjustable settings can relate to various aspects and limits for multiple payline games at low denominations, such that players can be prevented from wagering a small coin or fraction of a coin on a single payline or play. Another advantage of the various systems and methods disclosed herein is the ability to increase rates of game play and player conveniences resulting therefrom. This is accomplished in part by the introduction of automated calculations that take the place of ordinarily time consuming manual player inputs, which is particularly useful to the gaming operator in that more games per minute can now be played on such improved gaming machines and systems. By providing such streamlined player options and automated calculations, it is thought that the resulting expedited game play should result in a more enjoyable overall gaming experience for players as well.

Figure 1:
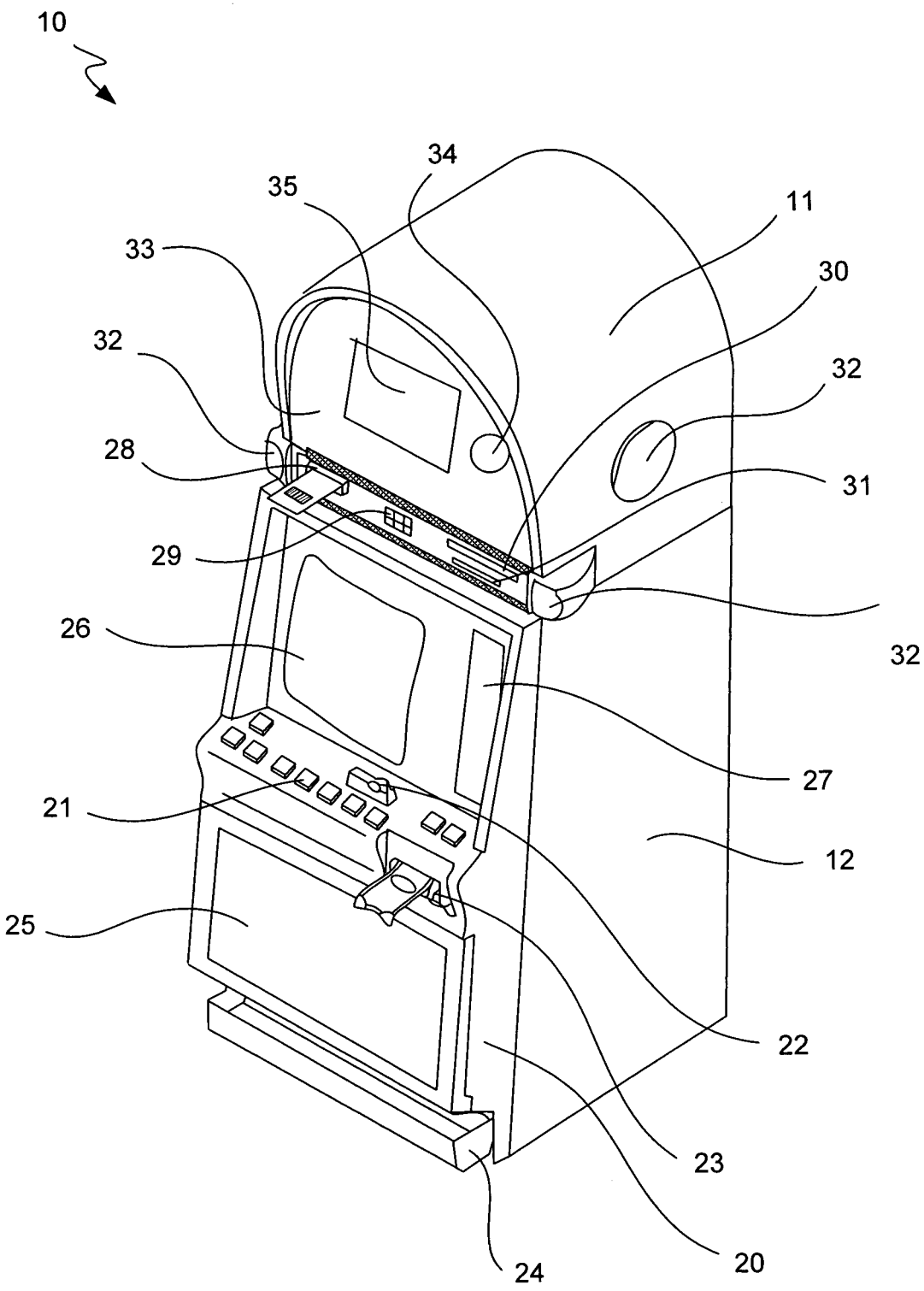
FIG. 1 illustrates in perspective view an exemplary gaming machine.

Referring first to FIG. 1, an exemplary gaming machine is illustrated in perspective view. Gaming machine 10 includes a top box 11 and a main cabinet 12, which generally surrounds the machine interior (not shown) and is viewable by users. This top box and/or main cabinet can together or separately form an exterior housing adapted to contain a plurality of internal gaming machine components therein. Main cabinet 12 includes a main door 20 on the front of the gaming machine, which preferably opens to provide access to the gaming machine interior. Attached to the main door are typically one or more player-input switches or buttons 21, one or more money or credit acceptors, such as a coin acceptor 22 and a bill or ticket validator 23, a coin tray 24, and a belly glass 25. Viewable through main door 20 is a primary video display monitor 26 and one or more information panels 27. The primary video display monitor 26 will typically be a cathode ray tube, high resolution flat-panel LCD, plasma/LED display or other conventional or other type of appropriate video monitor. Alternatively, a plurality of gaming reels can be used as a primary gaming machine display in place of display monitor 26, with such gaming reels preferably being electronically controlled, as will be readily appreciated by one skilled in the art.

Top box 11, which typically rests atop of the main cabinet 12, may contain a ticket printer 28, a key pad 29, one or more additional displays 30, a card reader 31, one or more speakers 32, a top glass 33, one or more cameras 34, and a secondary video display monitor 35, which can similarly be a cathode ray tube, a high resolution flat-panel LCD, a plasma/LED display or any other conventional or other type of appropriate video monitor. Alternatively, secondary display monitor 35 might also be foregone in place of other displays, such as gaming reels or physical dioramas that might include other moving components, such as, for example, one or more movable dice, a spinning wheel or a rotating display, among others. It will be understood that many makes, models, types and varieties of gaming machines exist, that not every such gaming machine will include each of the foregoing items, and that many gaming machines will include other items not shown. Such gaming machines are made by many manufacturers, such as, for example, IGT.

With respect to electronic gaming machines in particular, the electronic gaming machines made by IGT are provided with special features and additional circuitry that differentiate them from general-purpose computers, such as a laptop or desktop personal computer ("PC"). Because gaming machines are highly regulated to ensure fairness, and in many cases are operable to dispense monetary awards of millions of dollars, hardware and software architectures that differ significantly from those of general-purpose computers may be implemented into a typical electronic gaming machine in order to satisfy security concerns and the many strict regulatory requirements that apply to a gaming environment. A general description of many such specializations in electronic gaming machines relative to general-purpose computing machines and specific examples of the additional or different components and features found in such electronic gaming machines will now be provided.

At first glance, one might think that adapting PC technologies to the gaming industry would be a simple proposition, since both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

Accordingly, one difference between gaming machines and common PC based computers or systems is that gaming machines are designed to be state-based systems. In a state-based system, the system stores and maintains its current state in a non-volatile memory, such that in the event of a power failure or other malfunction the gaming machine will return to its current state when the power is restored. For instance, if a player were shown an award for a game of chance and the power failed before the award was provided, the gaming machine, upon the restoration of power, would return to the state where the award was indicated. As anyone who has used a PC knows, PCs are not state machines, and a majority of data is usually lost when a malfunction occurs. This basic requirement affects the software and hardware design of a gaming machine in many ways.

A second important difference between gaming machines and common PC based computer systems is that for regulation purposes, the software on the gaming machine used to generate the game of chance and operate the gaming machine must be designed as static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulator in a particular jurisdiction and installed in the presence of a person representing the gaming jurisdiction. Any change to any part of the software required to generate the game of chance, such as, for example, adding a new device driver used by the master gaming controller to operate a device during generation of the game of chance, can require a new EPROM to be burnt, approved by the gaming jurisdiction, and reinstalled on the gaming machine in the presence of a gaming regulator. Regardless of whether the EPROM solution is used, to gain approval in most gaming jurisdictions, a gaming machine must demonstrate sufficient safeguards that prevent an operator of the gaming machine from manipulating hardware and software in a manner that gives the operator an unfair or even illegal advantage over a player. The code validation requirements in the gaming industry affect both hardware and software designs on gaming machines.

A third important difference between gaming machines and common PC based computer systems is that the number and kinds of peripheral devices used on a gaming machine are not as great as on PC based computer systems. Traditionally in the gaming industry, gaming machines have been relatively simple in the sense that the number of peripheral devices and the number of functions on the gaming machine have been limited. Further, the functionality of a gaming machine tends to remain relatively constant once the gaming machine is deployed, in that new peripheral devices and new gaming software is infrequently added to an existing operational gaming machine. This differs from a PC, where users tend to buy new and different combinations of devices and software from different manufacturers, and then connect or install these new items to a PC to suit their individual needs. Therefore, the types of devices connected to a PC may vary greatly from user to user depending on their individual requirements, and may also vary significantly over time for a given PC.

Although the variety of devices available for a PC may be greater than on a gaming machine, gaming machines still have unique device requirements that differ from a PC, such as device security requirements not usually addressed by PCs. For instance, monetary devices such as coin dispensers, bill validators, ticket printers and computing devices that are used to govern the input and output of cash to a gaming machine have security requirements that are not typically addressed in PCs. Many PC techniques and methods developed to facilitate device connectivity and device compatibility do not address the emphasis placed on security in the gaming industry. To address some of these issues, a number of hardware/software components and architectures are utilized in gaming machines that are not typically found in general-purpose computing devices, such as PCs. These hardware/software components and architectures include, but are not limited to, items such as watchdog timers, voltage monitoring systems, state-based software architectures and supporting hardware, specialized communication interfaces, security monitoring, and trusted memory.

A watchdog timer is normally used in IGT gaming machines to provide a software failure detection mechanism. In a normal operating system, the operating software periodically accesses control registers in a watchdog timer subsystem to "re-trigger" the watchdog. Should the operating software not access the control registers within a preset timeframe, the watchdog timer will time out and generate a system reset. Typical watchdog timer circuits contain a loadable timeout counter register to allow the operating software to set the timeout interval within a certain time range. A differentiating feature of some preferred circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. IGT gaming machines, however, typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT gaming machine game software is to use a state machine. Each function of the game (e.g., bet, play, result) is defined as a state. When a game moves from one state to another, critical data regarding the game software is stored in a custom non-volatile memory subsystem. In addition, game history information regarding previous games played, amounts wagered, and so forth also should be stored in a non-volatile memory device. This feature allows the game to recover operation to the current state of play in the event of a malfunction, loss of power, or the like. This is critical to ensure that correct wagers and credits are preserved. Typically, battery backed RAM devices are used to preserve this critical data. These memory devices are not used in typical general-purpose computers. Further, IGT gaming computers normally contain additional interfaces, including serial interfaces, to connect to specific subsystems internal and external to the gaming machine. The serial devices may have electrical interface requirements that differ from the "standard" EIA RS232 serial interfaces provided by general-purpose computers. These interfaces may include EIA RS485, EIA RS422, Fiber Optic Serial, optically coupled serial interfaces, current loop style serial interfaces, and the like. In addition, to conserve serial interfaces internally in the gaming machine, serial devices may be connected in a shared, daisy-chain fashion where multiple peripheral devices are connected to a single serial channel.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this. In addition, security monitoring circuits detect intrusion into an IGT gaming machine by monitoring security switches attached to access doors in the gaming machine cabinet. Preferably, access violations result in suspension of game play and can trigger additional security operations to preserve the current state of game play. These circuits also function when power is off by use of a battery backup. In power-off operation, these circuits continue to monitor the access doors of the gaming machine. When power is restored, the gaming machine can determine whether any security violations occurred while power was off, such as by software for reading status registers. This can trigger event log entries and further data authentication operations by the gaming machine software.

Trusted memory devices are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the gaming machine. The code and data stored in these devices may include, for example, authentication algorithms, random number generators, authentication keys, operating system kernels, and so forth. The purpose of these trusted memory devices is to provide gaming regulatory authorities a root trusted authority within the computing environment of the gaming machine that can be tracked and verified as original. This may be accomplished via removal of the trusted memory device from the gaming machine computer and verification of the secure memory device contents in a separate third party verification device. Once the trusted memory device is verified as authentic, and based on the approval of verification algorithms contained in the trusted device, the gaming machine is allowed to verify the authenticity of additional code and data that may be located in the gaming computer assembly, such as code and data stored on hard disk drives.

Mass storage devices used in a general-purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. In addition to the basic gaming abilities provided, these and other features and functions serve to differentiate gaming machines into a special class of computing devices separate and distinct from general-purpose computers.

With respect to the basic gaming abilities provided, it will be readily understood that gaming machine 10 can be adapted for presenting and playing any of a number of gaming events, particularly games of chance involving a player wager and potential monetary or other payout, such as, for example, a wager on a sporting event or general play as a slot machine game, a keno game, a video poker game, a video blackjack game, a video table game and/or any other Class II or Class III game, among others. While gaming machine 10 can typically be adapted for live game play with a physically present player, it is also contemplated that such a gaming machine may also be adapted for game play with a player at a remote gaming terminal. Other features, functions and devices may also be used in association with gaming machine 10, and it is contemplated that the present invention can be used in conjunction with a gaming machine or device that might encompass any or all such additional types of features, functions and devices. One item that is specifically contemplated for use with the present invention involves a specialized gaming machine or system that incorporates improved payline and wagering options for low denomination games, as described in greater detail below.

Figure 2A:
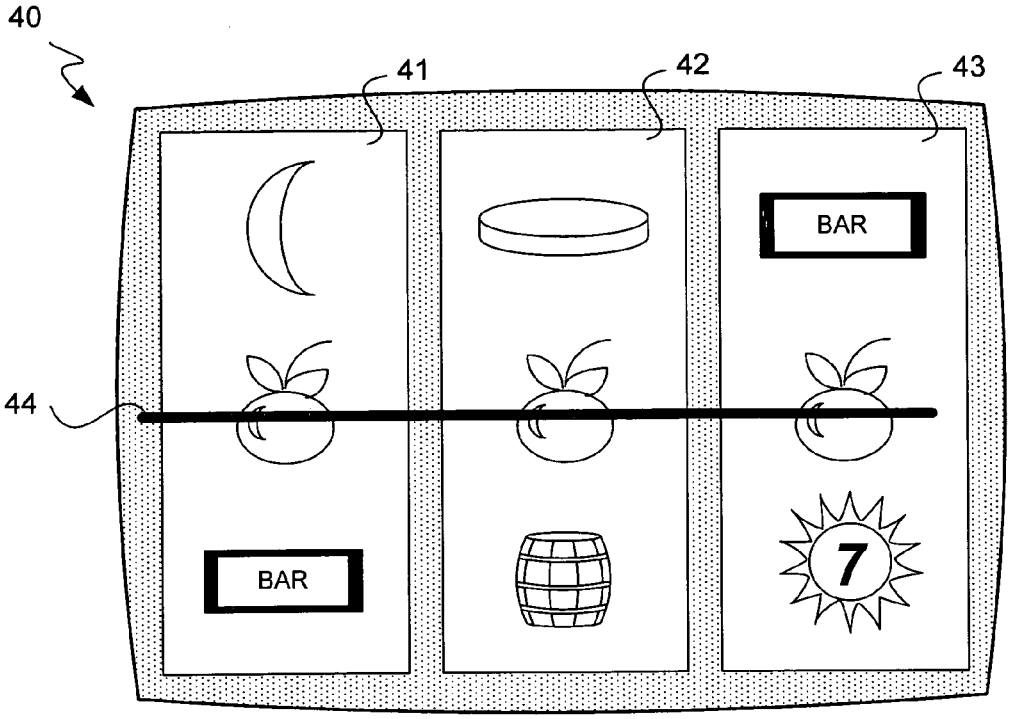
FIG. 2A illustrates in screen shot format an exemplary game outcome for a standard slots style game having a single payline.
Figure 2B:
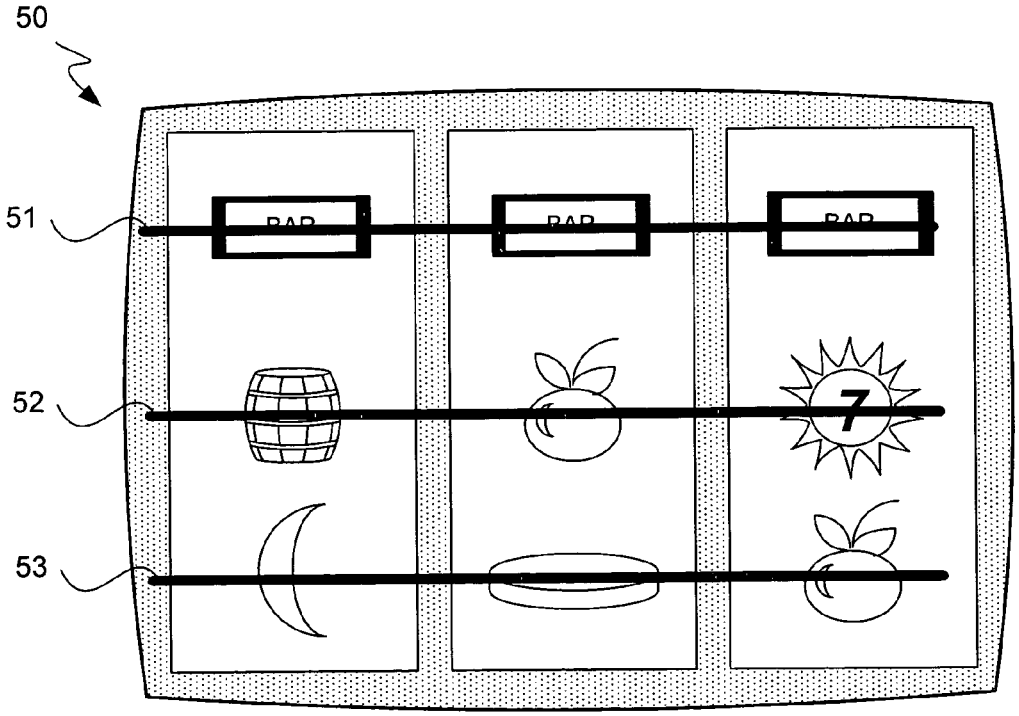
FIG. 2B illustrates in screen shot format another exemplary game outcome for a similar standard slots style game having three paylines.

Turning next to FIGS. 2A and 2B, two exemplary screen shots showing game results are provided. It will be readily appreciated that these screen shots could be taken from, for example, primary display 26 of gaming machine 10 from FIG. 1, as well as a variety of other types of screens or displays. For example, the reels shown in both screen shots can be graphical reels generated electronically, or can be actual physical reels. FIG. 2A illustrates a screen shot 40 of an exemplary game outcome for a standard slots style game having a single payline. Three distinct gaming reels 41, 42, 43 having various reel symbols thereupon are made to rotate either physically or through simulated rotation graphically after a player wager and upon a player initiation of a game play. As is generally known, after the reels stop, the symbols that fall along an appropriate payline can result in a monetary or other game award, depending upon the paytable used for the game. For example, in screen shot 40, the game outcome along single payline 44 shows three consecutive cherries, which would likely result in an award. The other bar, moon, coin, barrel and lucky 7 symbols are not accounted for in this single payline game.

FIG. 2B illustrates a screen shot 50 of an exemplary game outcome for a standard slots style game having three paylines that are played simultaneously. Three distinct gaming reels having various reel symbols thereupon are again used, as in the previous example, only here there are three paylines 51, 52, 53, where an appropriate combination of symbols across any or all of the three paylines could result in a monetary award or other win. For example, paylines 52 and 53 would likely not result in any kind of award, but the three bars across payline 51 would typically result in a significant award. Although general "winning" combinations have been shown for both of these examples, it will be readily appreciated that there are also many non-winning combinations of symbols for both the one payline and three payline games. It will also be readily appreciated that while the two brief examples illustrate games played with three reels, one or three paylines, and symbols such as cherries, bars, coins and the like, that many other games may be configured and similarly played with any number of reels, paylines and assorted types of reel symbols, including blank spaces as reel symbols.

Figure 3:
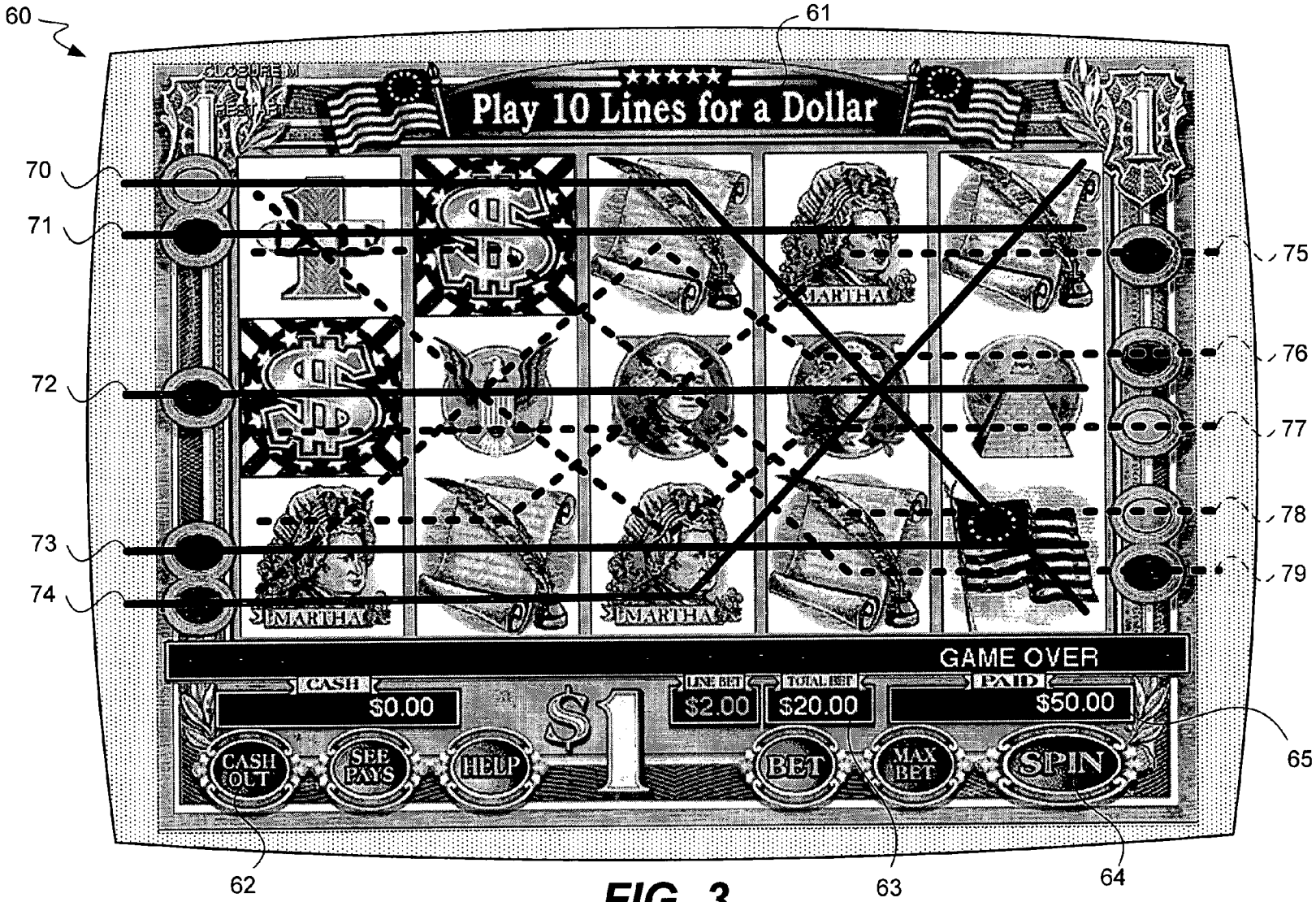
FIG. 3 illustrates in screen shot format yet another exemplary game outcome for a different slots style game having ten paylines.

Continuing on to FIG. 3, yet another screen shot of an exemplary game outcome for a different slots style game having ten paylines is shown. Screen shot 60 actually depicts a game outcome for the "By George" game, as noted above, and is used herein simply for purposes of illustration. As will be understood, elements of the game result in screen shot 60 are similar to those of the game results from screen shots 40 and 50 above. For example, there are a plurality of reels or simulated reels having reel symbols, various paylines, and combinations of symbols that can result in a win for a player. As can be seen, however, notable differences include the number of reels, of which there are five, more detailed and themed reel symbols, and a notable increase in the number and complexity of paylines. Various additional graphical items and features are also included, such as a banner ad 61, a touch screen button for a player cash out 62, an overall or total bet display 63, a touch screen button for a game initiation or "spin" 64 and a winning "paid" display 65, among others. Ten paylines 70-79 are also available for play for any given game played. For purposes of illustration and ease in following which lines cross which symbols, half of the paylines shown are solid lines, while the other five are broken lines. It will be understood that no significant distinction exists between the solid and broken lines.

As noted above, it is becoming increasingly popular to provide even more paylines and more player options in modern gaming machines, particularly in penny or other low denomination games. While the foregoing examples illustrate games having 1, 3 and 10 paylines, there are other games known to have even more paylines. In fact, upwards of 100 paylines or more could be possible given the proper factors and circumstances within a particular game. Such large numbers of paylines can be made possible by, for example, adding reels and/or permitting alternatives to general right-to-left paylines, particularly where virtual reels are graphically generated. In general, various diagonal, vertical or regional "paylines" might also be utilized to arrive at an overall number of 100 paylines or more. Of course, it is preferable that any and all such paylines be available for perusal by a player or prospective player, such as, for example, by permitting various button or touch screen inputs to show where different paylines occur, as is generally known in the art.

As also noted above, it is becoming increasingly desirable for casinos and other gaming operators to be able to have more options with respect to various limits that can be placed on different game parameters. It shall also be understood that a gaming machine "operator" and a gaming machine "player" are two different and distinct entities, with the operator being the entity that provides and administers the gaming machine, and the player being the entity that simply wagers money and plays games at the gaming machine. While persons who act as gaming operators may indeed play games and therefore occasionally act as players with respect to gaming machines and system, it is generally understood for purposes of discussion herein that the various gaming machine "limits" and "operator adjustable settings" provided by the present invention are done with respect to gaming operators, and not players. Conversely, the variables that are available to players that fall within the operator set settings and limits are referred to herein as specific game "parameters." Various specialized gaming machine and system embodiments that permit and expand on such gaming operator options and player parameters will now be discussed.

With respect to outward appearance, the specialized gaming machines disclosed herein can appear to be identical or substantially similar to the general exemplary gaming machine 10 of FIG. 1 described above. In fact, FIG. 7 below depicts such a "specialized" gaming machine 90 with respect to an overall gaming system 300 that may also include one or more regular gaming machines 10. Similar to these foregoing exemplary gaming machines, a specialized gaming machine of the present invention preferably includes a button or other input mechanism, such as on a touch screen or a button panel, for each of the various "game denomination," "credits played," "paylines played," "credits per payline" and other variable parameters that might be made available to players. Discrete convenience buttons can also be provided, such as, for example, "bet up" buttons of varying amounts, such as "up1," "up10," "up100" and so forth. For example, where a player has selected the betting denomination to be less than a penny, then the "up1" button could be set as disabled for such situations. In addition, one or more configuration devices or "configurators" can also be provided and made available to the gaming operator and associated personnel authorized to change one or more operator adjustable settings on the specialized gaming machine. Preferably, any such configuration device or configurator is not made available to ordinary players of the gaming machine.

In one embodiment, such configuration devices or configurators can include manual devices, such as a button, knob, dial, switch, keyboard and/or graphical user interface, among others. Such manual devices can be installed within the gaming machine and made available to an authorized person accessing the machine interior. Alternatively, such devices can be portable and used at the gaming machine once certain areas have been accessed. In addition, such configuration devices or configurators can include an interface to a remotely located server or other computing device in communication with the gaming machine or terminal, with such a server or computing device being adapted to make desired changes to the subject gaming machine electronically. The gaming machine configurator can also include internal logic within the gaming machine itself, such as at the MGC or an associated MGC storage device. In fact, a wide variety of items can be used to implement the configuration device or devices of the present invention, and it is contemplated that any such suitable device or devices be used.

In the event that a computing device is used, such as a remote server or internal logic within the gaming machine itself, such a computing device can be adapted to reconfigure one or more of the operator adjustable settings or options automatically in response to a triggering event. Such triggering events could include a specific date, a specific time and/or a threshold level of recent inactivity at the gaming machine, among other items. For example, a casino may wish to promote a theme of "Low Roller Thursdays," where the minimum overall wager is reduced to a penny on Thursday evenings. Such a promotion might be made available to all players, or alternatively only to select players as identified via tracking cards, for example. In any event, the appropriate operator adjustable settings could be altered automatically at the desired time and for the desired period of time every Thursday night. Under another variation, one or more operator adjustable settings can be altered automatically when the gaming machine or system has detected that there has been no play at the machine for a set period of time, such as, for example, one hour. Where no play has been made for this set period of time, the gaming machine might then reconfigure for a special promotion period with lowered settings or options, such as, for example, fifteen minutes starting with the first play of the machine under such a reconfiguration. A specialized attract mode by the gaming machine advertising the newly reconfigured settings might also be implemented and automated.

Under various embodiments of the present invention, a variety of specific operator adjustable settings can be provided. Such settings can include, for example, a minimum overall wager and a maximum overall wager that can be placed by a player to play a game at the gaming machine or terminal, as well as various available denominations of play, a minimum number of paylines to be played, and an incremental value to any player selectable number of paylines to be played, among others. It will be understood that the "overall wager" represents the total amount wagered by the player across all paylines for a given play, and that the "maximum" and "minimum" settings for this amount establish the limits set by the gaming operator for a particular gaming machine. Preferably, both the minimum and maximum overall wagers are multiples of a selected denomination of play, such as, for example, a penny. Players are thus permitted to select an overall wager for any given play at a range from the set minimum, if any, to the set maximum, if any.

In various embodiments, a specialized gaming machine can offer gaming operators and/or players, as the machine may be set, a variety of denominations, including at least one denomination at a small coin of a currency local to the gaming machine, such as a penny or below for U.S. markets. For example, denominations of 25¢, 5¢, 1¢, ½¢, ⅕¢ and 1/10¢ can be offered. Thus, the denomination settings can be operator adjustable as well as player selectable. The number of paylines available for a given play can also be an operator adjustable setting. For example, while some operators might want to allow player selection of paylines and permit players to play anywhere from 1 to 100 paylines or more, other operators might not desire to permit any player input as to the number of paylines to be played. Or, where player input is to be permitted with respect to paylines, such input is limited to a set minimum number of paylines or a limited incremental increase. For example, a particular payline setting might permit a player to select from 10, 15, 20 or 25 paylines to play only. Here, the operator set minimum would be 10 paylines, and the operator adjusted paylines wagered incremental value would be 5 paylines. Of course, other operator adjustable settings might also be made available, and such additional settings are also contemplated for use with the present invention.

It will be readily appreciated that even though a variety of operator adjustable settings might exist, that many such variables can be set or "defaulted" upon manufacture of the gaming machine, such that a gaming machine maker might also be considered an "operator" in a sense. When a specialized gaming machine is then delivered to the floor of a casino or other gaming establishment, the gaming machine owner or operator can then custom configure one or more of the above items as desired. Of course, reconfiguration of one or more operator adjustable settings may also take place at various times, as desired. As noted above, such configurations can be made manually, in automated fashion, or as some combination thereof. The availability of such operator adjustable settings offers significant advantages to the operator in that the operator can at least make sure that people are not using the penny games of the casino as a place to make 1¢ wagers stay warm or garner free drinks.

In one embodiment, a specialized gaming machine can be configured such that when the gaming operator adjusts the operator adjustable settings as desired, that only the choices listed are made available to the player. For example, the gaming machine may have logic to disable credit options that do not meet a minimum overall wager requirement. Where the minimum overall wager is set to 10¢ by the gaming operator, then the gaming machine would disable any wagering buttons or other input options that would result in a wager of less than 10¢, such as, for example, a 1¢ button or input. As another example, where the gaming operator adjusts the settings for a given gaming machine such that no fewer than 15 paylines can be played for any given game, then any buttons or inputs permitting exactly 5 or 10 paylines would become disabled. Of course, such input disablement could also occur for select plays of the gaming machine based on various player inputs. For example, where the wagering buttons include "up1," "up10" and "up100" options, all such buttons could then be active where a default or selected denomination of play is a quarter (i.e. 25¢). However, if a player then changes this denomination to 1/10¢, then the "up1" button would likely become disabled for play at this denomination. In fact, where 1/10 or lower is the play denomination, it may even be desirable to disable an "up10" button.

In addition, an operator adjustable setting for a minimum bet increment can be provided. Such a minimum bet increment could represent a multiple of the game denomination to be played, where players would be permitted to change their overall bet only in accordance to the operator set bet increment. For example, where the denomination of the game is selected to be 1¢, the minimum overall wager could be set to 5¢ and the minimum bet increment could then be set to 5 (i.e., 5×1¢), such that players would only be permitted to place an overall wager of 5¢, 10, 15¢, 20¢, and so forth. Of course, the minimum overall wager and minimum bet increment could be adjusted as desired by a given gaming operator. As another example, where the game denomination is 1/10¢, the minimum overall wager is adjusted to be 25¢ and the minimum bet increment is set to be 10 for any 1/10¢ denomination game, players would then be permitted to place overall wagers of 25¢, 26¢, 27¢ and so forth. An additional button or buttons for generic or customized "bet up" inputs may also be provided, particularly in such instances where an operator adjustable setting for a minimum bet increment is provided. For example, a simple generic "bet up" button can be provided to increase the overall wager amount by the set minimum bet increment every time the button is pushed.

As noted above, an operator is preferably able to access and alter the various operator adjustable settings from a central server, locally at the gaming machine itself, or both. To access locally, the operator could open the main door of the gaming machine with an appropriate key or access device, where one or more buttons, switches or other manual input items are available. In one embodiment, a single internal switch could be activated, whereupon a menu is then presented to the operator on a screen of the gaming machine, such as a primary display screen. This menu could provide a variety of options to the operator, at least one of which might involve a "setup"

or similar option. Where such a "setup" option is selected, a submenu might then present a variety of additional options, such as a "wager" setup. When selected, the "wager" setup could then present a wager setup screen with a variety of operator adjustable settings. For example, such a wager setup screen might depict a variety of default settings, such as a minimum overall wager of $0.01, a maximum overall wager of $3000.00 (the maximum in Nevada), and a minimum bet increment of $0.01, as well as a number of paylines minimum of 1, and a paylines to be played incremental value of 1. Under such default settings, a player would be free to wager any amount from $0.01 to $3000.00, and play any number of paylines.

Figure 4A:
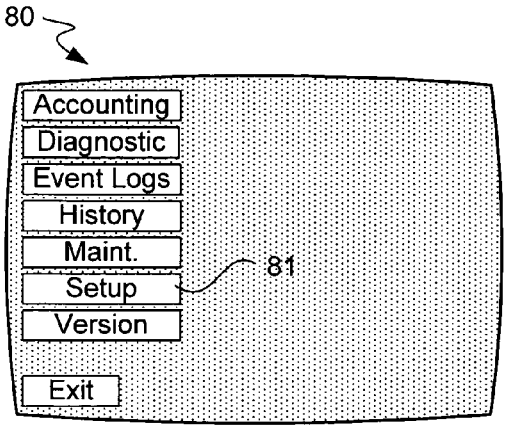
FIGS. 4A-4F illustrate in screen shot format various representations of a graphical user interface used as part of a manual configurator according to one embodiment of the present invention.
Figure 4B:
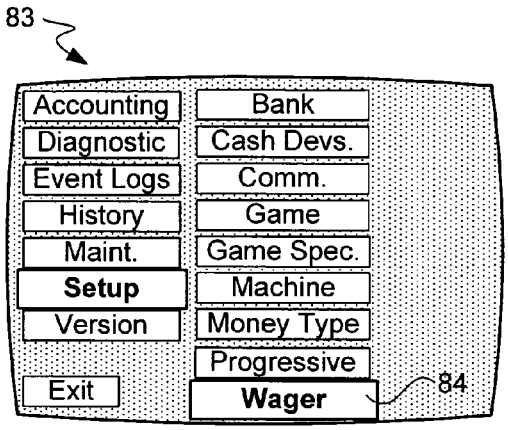
Figure 4C:
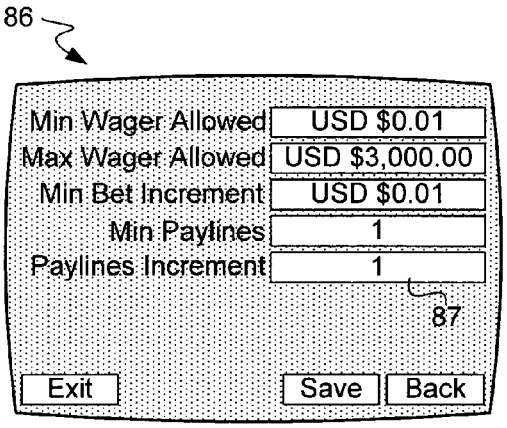

Referring next to FIGS. 4A-4F, various representations of a graphical user interface used as part of a manual configurator are illustrated in screen shot format. FIGS. 4A-4C essentially depict that which is described above, where an operator accessing the graphical user interface, such as through an internal switch, is able to select from a number of options to reach a variety of different screens and further options. From FIG. 4A, screen 80 depicts an initial menu having a variety of buttons or other input options 81, one or more of which can involve a "Setup" for configuring one or more gaming machine parameters. As shown in screen 83 of FIG. 4B, a submenu with further options or inputs 84 can be made to appear once this "Setup" option has been selected, with one such further option being that for a "Wager" setup. As shown in screen 86 of FIG. 4C, selection of such a "Wager" option can result in the presentation of one or more operator adjustable settings, such as those shown. One or more setting boxes or inputs 87 might then be selected by the operator to adjust the present setting for that item, which present setting can be displayed.

Figure 4D:
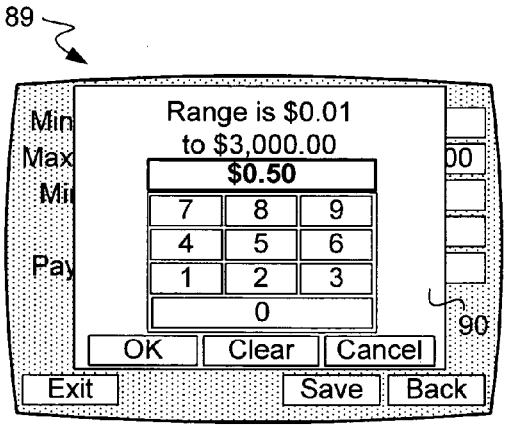
Figure 4E:
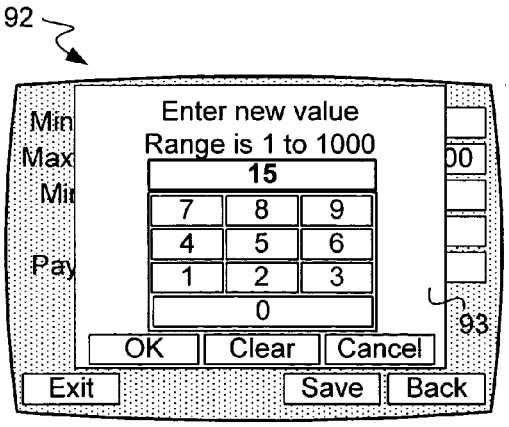
Figure 4F:
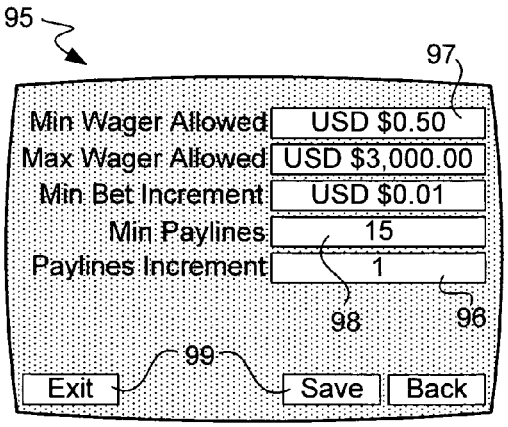

Upon selection of such a setting box or input, a further input box or item might be provided, such as that which is shown in screen 89 of FIG. 4D. In this limited example, the "Min Wager Amount" box from FIG. 4C has been selected, whereupon a further input box 90 is presented. Such a further input box 90 might be presented in isolation, or might be superimposed on the existing screen image, as is shown. Additional buttons or other inputs within this further input box 90 might then permit the operator to adjust the selected operator adjustable setting. As is shown in FIG. 4D, the minimum overall wager allowed has been adjusted to $0.50. As will be readily appreciated, one or more additional inputs or buttons might then be used to save or "OK" the selection that has been input. Continuing on to FIG. 4E, another operator adjustable setting has been selected. As shown in screen 92, the operator adjustable setting for the minimum number of paylines to be played has been chosen, whereupon another further input box 93 has been superimposed or otherwise provided on the display screen. As also shown, the operator selected input for this setting has been raised to 15. As shown in the final screen 95 of FIG. 4F, screen 86 of FIG. 4C has been replicated and updated to reflect the new inputs that were made from FIGS. 4D and 4E. As in screen 86, screen 95 also has one or more setting boxes or inputs 96, such that the present settings can be adjusted or readjusted, as desired. In addition, the new minimum overall wager 97 is reflected, as well as the new minimum number of paylines 98. As will be readily appreciated, a variety of buttons or other inputs 99 to assist the operator in navigating the graphical user interface can also be provided, with such additional inputs including those for save, back and exit features, among others.

In many embodiments, an automated game preparation component is provided within the specialized gaming machine. Such an automated game prep component can be adapted to accept game parameter input from a player and to provide automatically further game parameters based upon the player selected game parameter inputs. As generally noted above, a player can be permitted to select from a variety of parameters within limits set by the operator through operator adjustable settings. Such player selectable parameters can include, for example, the game denomination, the overall amount wagered between the minimum and maximum overall bet settings, the number of paylines to be played and the credits per payline, among other items. However, one or more of these aspects are preferably determined automatically in order to expedite game play. In particular, a player might be allowed to select a denomination or acquiesce in a default denomination setting, and to make an affirmative choice as to what the overall wager will be for a game, whereupon the gaming machine or system can then automatically determine the number of paylines to be played and the number of credits to be wagered per payline. An additional player activation or initiation of the game may then be necessary, if desired.

Based upon the denomination selected or that is otherwise in use by default, the gaming machine can enable various wagers of credits, such as, for example, 1, 5, 10, 50, 200 or 1000 credits. Wagers of actual monetary amounts might also be used, although credits tend to work well, particularly where denominations might be changed at the gaming machine. In general, each credit can translate to one betting unit at the denomination being used. For example, 1000 credits at a 1/10¢ denomination would be worth $1, while 1000 credits at a 5¢ denomination would be worth $50. As will be readily appreciated, even where a choice in the denomination is provided, most players generally do not switch denominations from game to game. That is to say, a player desiring to play a 1¢ game will typically make that adjustment and then play many games consecutively at that denomination. Hence, it is usually not necessary to force players to select a game denomination for each game, but rather preferable to allow players to change the denomination when desired.

In a preferred embodiment, once the denomination is determined, the player can then select the number of credits to play for a given game, which would represent the overall wager. The automated game preparation component of the gaming machine could then kick in to determine the number of paylines and the credits wagered per payline in association with the overall wager just made by the player. Preferably, the player does not choose credits per payline or the number of paylines, although these parameters could certainly be made available to the player by the operator, if desired. In this manner, the number of choices and inputs that must be made by a player can be reduced, and the overall gaming process thereby expedited. After the player chooses or agrees to the game denomination and then chooses the overall wager or number of credits to wager, the internal logic of the automated game prep component then calculates the remaining game parameters from a number of possibilities. This concept is summarized in Table I —Game Parameters, where the player selected or approved parameters include the game denomination and the overall credits or monetary amount to be wagered, while the automatically calculated parameters include the number of paylines and credits wagered per payline.

TABLE I

| Game Parameters | | | | |
|---|---|---|---|---|
| Player Selected or Approved Parameters | | | Auto-Calculated Parameters | |
| | Total | | | |
| Denomination | Credits | OR Total Wager | Paylines | Credits per Line |
| 25¢ | 1 | 25¢ | 1 | 1 |
| | 5 | $1.25 | 5 | 1 |

TABLE I-continued

| Game Parameters | | | | |
|---|---|---|---|---|
| Player Selected or Approved Parameters | | | Auto-Calculated Parameters | |
| Denomination | Total Credits | OR Total Wager | Paylines | Credits per Line |
| | 10 | $2.50 | 10 | 1 |
| | 20 | $5.00 | 10 | 2 |
| 5¢ | 1 | 5¢ | 1 | 1 |
| | 5 | 25¢ | 5 | 1 |
| | 10 | 50¢ | 10 | 1 |
| | 20 | $1.00 | 10 | 2 |
| | 50 | $2.50 | 10 | 5 |
| | 100 | $5.00 | 20 | 5 |
| 1¢ | 1 | 1¢ | 1 | 1 |
| | 5 | 5¢ | 5 | 1 |
| | 10 | 10¢ | 10 | 1 |
| | 20 | 20¢ | 10 | 2 |
| | 50 | 50¢ | 10 | 5 |
| | 100 | $1.00 | 20 | 5 |
| | 200 | $2.00 | 20 | 10 |
| | 500 | $5.00 | 50 | 10 |
| 1/10¢ | 10 | 1¢ | 10 | 1 |
| | 20 | 2¢ | 20 | 1 |
| | 50 | 5¢ | 50 | 1 |
| | 100 | 10¢ | 50 | 2 |
| | 200 | 20¢ | 50 | 4 |
| | 500 | 50¢ | 50 | 10 |
| | 1000 | $1.00 | 100 | 10 |
| | 2000 | $2.00 | 100 | 20 |
| | 5000 | $5.00 | 100 | 50 |

Please replace paragraph 72 of the specification with the following amended paragraph.

As can be seen from the foregoing, while it may be up to the operator to configure a gaming machine for a minimum overall wager and/or other game settings, it is preferably up to the game logic as to how to distribute a given overall wager across multiple paylines and credits per payline. For example, a particular gaming machine might be set to decide that an overall wager of 50¢ at a 1¢ denomination game should result in 10 paylines at 5 credits per payline, as shown above. Of course, alternative settings of 5 paylines at 10 credits per payline might also be used. In fact, it is also contemplated that the manner in which the automated game prep component calculates these parameters can also be adjusted. For example, where a gaming operator perceives that too many paylines confuses and discourages players, a setting of 5 paylines at 10 credits per payline might be preferred. As is also noted above, it might also be desirable to permit players to select the number of paylines to be played manually, although this is a feature that is preferably included as another operator adjustable setting, as some operators may desire to turn off such flexibility.

An additional feature that can be included is an automated denomination switch. Depending upon the circumstances, the automated game preparation component might be configured to switch the game denomination where a player desires to play a certain number of paylines and/or a certain number of credits per payline. In this manner, where a player decides, for example, to select only one or a few paylines with the game denomination being low, such as at 1/10¢, for example, then the gaming machine can ratchet up the game denomination such that the overall minimum wager setting can be more easily met. This may become necessary where the player is permitted to and actually does select a low number of paylines and a low number of credits to be wagered per payline. Preferably, such an alteration of the game denomination is made with a warning or notice to the player prior to prompting the player to initiate or activate a new game play.

As seen from the foregoing, the present invention removes the ability of players to play a game for less than a particular overall wager amount as configured either by the operator or as a default setting implemented by the gaming machine manufacturer. For example, a 1¢ and 15 payline game could be configured for the minimum overall wager to be 15¢. If a player then puts in a $1 bill into the machine, he or she must then select at least a 15¢ overall wager before the play button or other activation input will start a game. Where a player has less than the minimum overall wager left on his or her credit meter, however, then the gaming machine might be configured to deal with such a "residual" amount in a number of ways. For example, there might be another option specifying whether or not the player is allowed to wager less than 15¢, if that is all that the player has left on the credit meter. In the foregoing $1 example, suppose the player wagered 15¢ for 6 games and lost every game. Now there is only 10¢ left on the credit meter of the gaming machine, with a minimum overall wager setting of 15¢. If a residual wager option were set accordingly, the player would then be allowed to play one more game for a wager of 10¢, because that was all that was left on the credit meter. Such an additional game could be a regular game, or could be a special "bonus game" with a different paytable and odds in comparison with the regular game, where the bonus game merely allows players to wager residual amounts as an exception to the minimum overall bet rule.

One or more other payout mechanisms or ways for resolving such residual amounts might also be employed. As in the example above, such residual amounts can generally comprise small amounts of credit or money, such as what might require multiple coins of different denominations to pay out (e.g., 37¢). Although such residual amounts might become common in cases of penny machines and other low denomination gaming machines, the actual breakdown of credits to a penny or fraction thereof for payouts can be problematic. One solution can involve the use of printed tickets, particularly where the residual amount is included with a larger total balance to be paid out to a player (e.g., $50.37, where the $0.37 component can be considered the residual amount), such that a player will likely not be annoyed by getting a printed ticket only for a residual amount.

Another such payout mechanism can be to utilize player accounts to permit residual portions of credit or money owed to the player to be carried over to another gaming session for that player at that gaming machine, or at any other gaming machine adapted for such purposes. An appropriate player tracking device and system could be used for this purpose. One possible solution could include forfeiture of a residual amount where a player desires a coin payout and the gaming machine is not equipped to dispense pennies or coins of multiple different denominations. Alternatively, such a residual portion could be donated to charity, such as by a player selection at the gaming machine from one or more possible charities. Such donations would likely be readily made by many players not inclined to recover their residual portions, particularly where such portions were all that remained. In addition, the gaming establishment and industry in general would be able to generate goodwill from providing a vehicle for donations to worth charities, where the sum of many such small donations could result in significant amounts.

Figure 5:
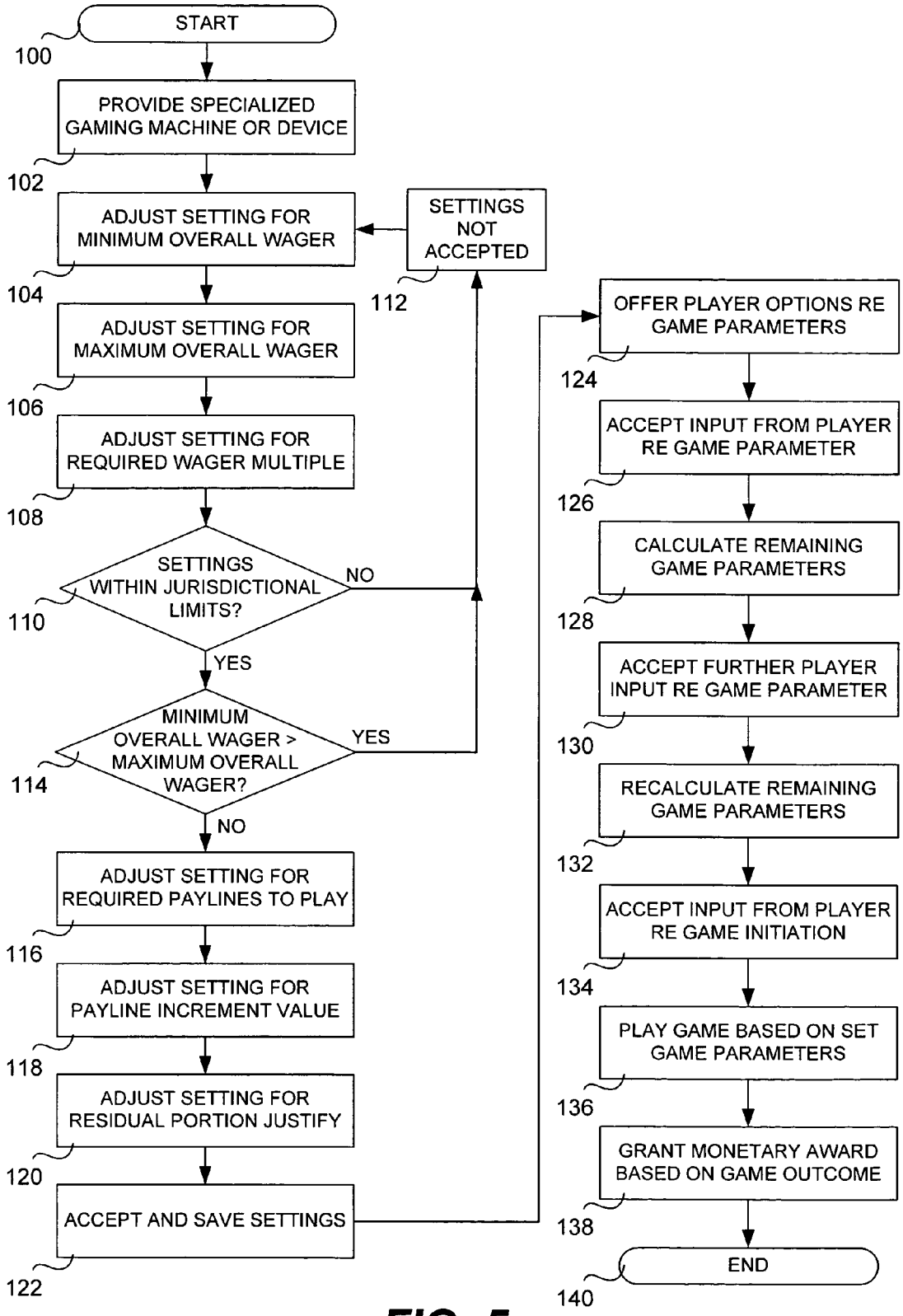
FIG. 5 illustrates a flowchart of one way of administering wager based games within a specialized gaming machine according to one embodiment of the present invention.

In general, the foregoing devices and systems can be utilized to benefit both gaming operators and players in creating and using specialized gaming machines and devices that are adapted to provide improved and streamlined payline and wagering options. As detailed above, this can be accomplished through use of one or more configuration devices or configurators, such as manual buttons or knobs, either physical or represented on a graphical user interface, as well as through automated logic within the gaming machine and/or an associated server. Turning now to FIG. 5, a flowchart conveying one way of administering wager based games within a specialized gaming machine according to an embodiment of the present invention is shown. While this flowchart may be comprehensive in some respects, it will be readily understood that not every step provided is necessary, that other steps can be included, and that the order of steps might be rearranged as desired by a given gaming operator, such as a manufacturer, a casino owner or casino personnel, a retrofitter, a repairperson or any other individual authorized to access and adjust the operator adjustable settings of a gaming machine or system.

After start step 100, a gaming machine or other relevant gaming device is provided at a process step 102. While such a device can be a specialized gaming machine having at least one configuration device and operator adjustable settings, as discussed above, it will also be understood that this gaming device could also be a gaming device similarly associated with such operator adjustable settings and that is used at a table game, sports book, keno lounge, or other gaming location. At a subsequent process step 104, an operator adjustable setting for the minimum overall wager at the gaming machine is adjusted by the operator. As in the case of this setting or any operator adjustable setting, such as those included below, such an adjustment can be made in any number of ways, including manually by the operator or any authorized individual, or in automated fashion, such as through a remote server or internal logic within the gaming machine. Alternatively, such an "adjust" setting step can be represented simply by an operator noting the present setting and deciding that such a current setting is appropriate, as will be readily appreciated. At process step 106, an operator adjustable setting for the maximum overall wager at the gaming machine is adjusted by the operator, and an operator adjustable setting for a required wager multiple is then adjusted at process step 108. Again, such adjustments can be made through manual or automated inputs, and it is also contemplated that such adjustments may only involve observance of and acquiescence in a current setting. It will also be appreciated that one or more additional operator adjustable settings can be adjusted, and that the specific order of such adjustments can be altered as desired.

In one embodiment, operator adjustable settings can be provided to establish jurisdictional limits for the jurisdiction where the gaming machine is located. Alternatively, such jurisdictional or other absolute limits can be established by another entity, such as the manufacturer of the gaming machine. In any event, such jurisdictional limits can provide an absolute limit or guide for one or more of the operator adjustable settings. For example, the state of Washington has a $5.00 upper limit on overall wagers, such that gaming machines shipped to or operated within that jurisdiction should have an absolute limit on the maximum overall wager set to $5.00. If a gaming machine operator then wanted to adjust the operator adjustable setting on the maximum overall wager of such a machine, such an adjustment would then be limited to all values of $5.00 or less. At decision step 110, an inquiry is then made as to whether all settings are within the jurisdictional limits. If not, then the method moves to process step 112 where the settings are not accepted, and then reverts to process step 104 for further inputs or adjustments by the gaming machine operator. Of course, the method could move from step 112 to some other step further up the process where appropriate, as will be readily appreciated.

If all jurisdictional limits have been met per the inquiry of decision step 110, however, then the method continues to decision step 114, where an inquiry is made as to whether the minimum overall wager has been set to be greater than the maximum overall wager. If so, then the method moves to process step 112 where the settings are not accepted, and then to process step 104 or another appropriate step for further operator inputs or adjustments, as noted above. If the result of decision step 114 is that the minimum and maximum overall wagers are proper in relation to one another, then the method continues to process step 1116, where an operator adjustable setting for the required number of paylines in order to play is adjusted. Such a setting could involve, for example, a minimum number of paylines that must be played.

The method continues to process steps 118 and 120, where operator adjustable settings for a payline increment value and residual portion justify or payout are set or adjusted as well. As noted above, such a payline increment value can involve a number of paylines that must be increased by a player to play more paylines than a minimum or currently set amount. For example, where such a value is set at 5 paylines with an overall minimum of 10 paylines to be played, then a player might be permitted to select from choices of only 10, 15, 20 or 25 paylines to be played. As also noted above, a variety of options might be provided with respect to resolving a residual portion or balance amount owed to a player. As one such possibility, an operator might be provided with an operator adjustable setting that would permit players to wager a residual portion below the minimum overall wager setting when the credit balance at a gaming machine falls below the minimum requirement. Again, such steps for adjusting settings can be arranged in any order, might be removed, and other such adjustment steps may be added, as desired.

At process step 122, the various adjusted or acquiesced operator adjustable settings are accepted and saved, and the gaming machine is then made available for play to players. At subsequent process step 124, various player options are provided to a player regarding one or more game parameters, such as denomination of play, overall wager, number of paylines to be played, and amount wagered per payline, among others. Of course, not all such items need to be made available, and it may even be under some operator adjustable settings to provide players with only one option, such as an overall wager amount to be made. At process step 126, an input is accepted from the player regarding one game parameter, upon which the remaining game parameters are automatically calculated at process step 128, as noted in detail above. In some embodiments it may be desirable to accept further input from the player regarding the same or another game parameter, which could happen at a process step 130, whereupon the remaining game parameters are then automatically recalculated at process step 132.

At process step 134, an input is accepted from the player regarding a game initiation or start, which could be accomplished by a button, handle or other input. A game is then played based on all set parameters at process step 136, with such set parameters including those selected by the player and those that have been calculated automatically by the gaming machine. Depending upon the game outcome, an award having monetary value or some other value can then be provided at process step 138, after which the method ends at end step 140. Of course, some game outcomes may not result in such a monetary or other award, although at least some will. Again, various details and additional steps may similarly be included, and it is specifically contemplated that many variations of these exemplary methods may also be practiced.

Figure 6:
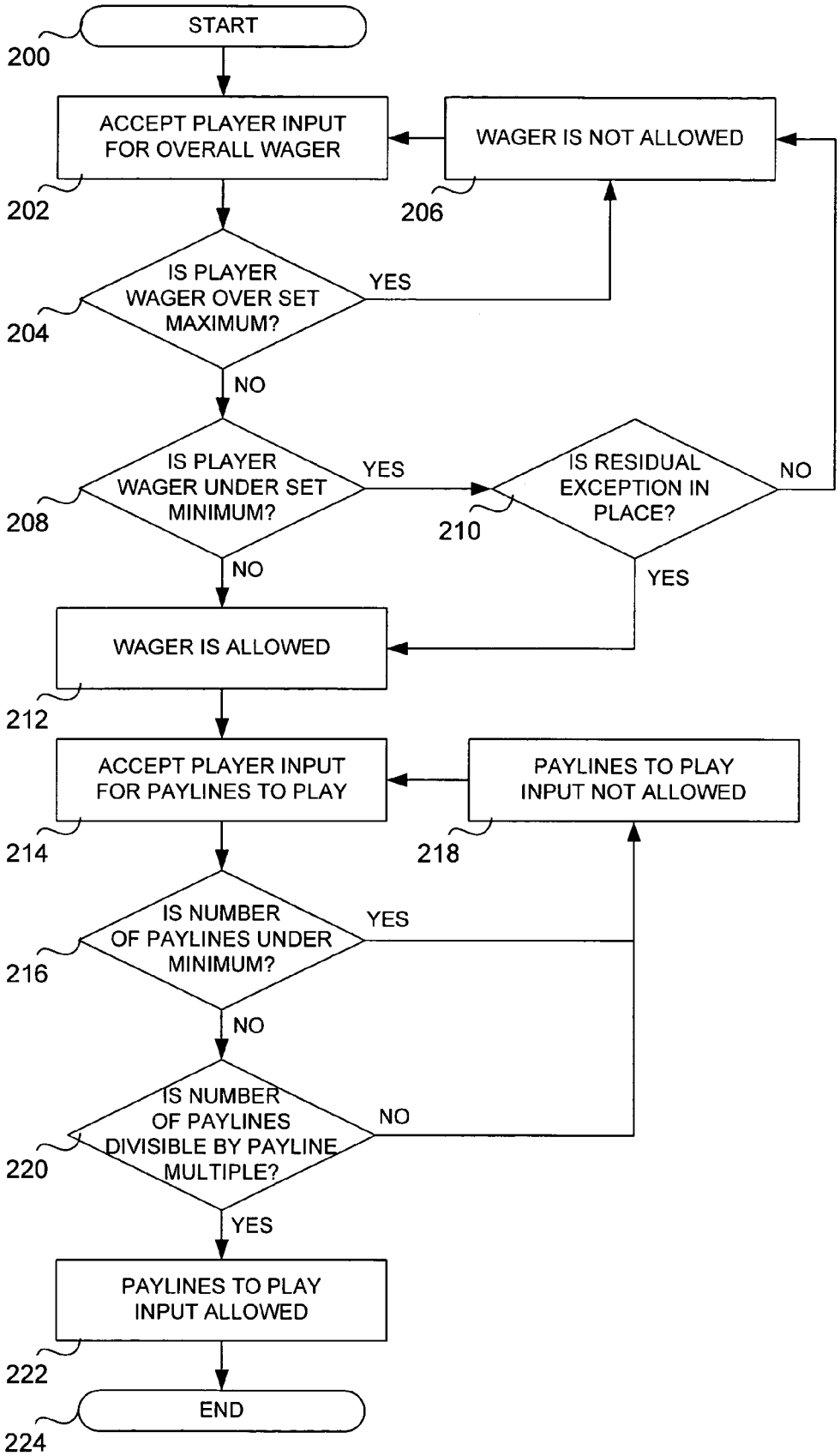
FIG. 6 illustrates a flowchart of one way of providing various player selectable parameters within operator adjusted settings within a specialized gaming machine according to one embodiment of the present invention.

FIG. 6 illustrates a flowchart of one way of providing various player selectable parameters within the operator adjusted settings within a specialized gaming machine according to one embodiment of the present invention. Again, it will be readily understood that not every step provided is necessary, that other steps can be included, and that the order of steps might be rearranged as desired. After start step 200, a player input regarding an overall wager is accepted at process step 202. An inquiry is then made at decision step 204 as to whether the player wager is over a maximum amount as set by the gaming operator. If so, then the method continues to process step 206, where the player wager is not allowed, and the method then reverts to step 202 for further player wager input. If not, however, then the method moves forward to decision step 208, where an inquiry is made as to whether the overall wager by the player is under a minimum amount as set by the gaming operator. If so, then the method moves to decision step 210, where another inquiry is made, this one regarding whether a residual exception to the set minimum bet rule is in place. If not, the method similarly moves to process step 206, where the player wager is not allowed, whereupon the method similarly reverts to step 202.

However, if the overall wager input by the player is not under the minimum set by the gaming operator, or if a residual exception is in place, then the method continues to process step 212, where the player wager is allowed. At process step 214, a player input for the number of paylines to be played is accepted. As noted above, such an option does not necessarily need to be made available to players. For purposes of discussion, however, it will be assumed that such an option has been made available by a given gaming operator. At a subsequent decision step 216, an inquiry is then made as to whether the number of paylines selected is under a minimum amount as set by the gaming operator. If so, then the method moves to process step 218, where the input as to the number of paylines to be played is not accepted, whereupon the method reverts to process step 214 for further input. Where the number of paylines is equal to or greater than the set minimum, however, then the method moves forward to decision step 220, where an inquiry is made as to whether the number of paylines selected is divisible by a selected payline multiple or incremental value. As noted in the example above, such an incremental value could be 5, for example, such that any number that is not at least the minimum and also a multiple of 5 would be improper. If the result of the inquiry at decision step 220 is negative, then the method similarly moves to process step 218, where the paylines to be played input is not allowed, whereupon the method then reverts to step 214. Where the inquiry result is position, however, then the method continues to process step 222, where the input for the number of paylines to be played is allowed. The method then ends at and end step 224.

Figure 7:
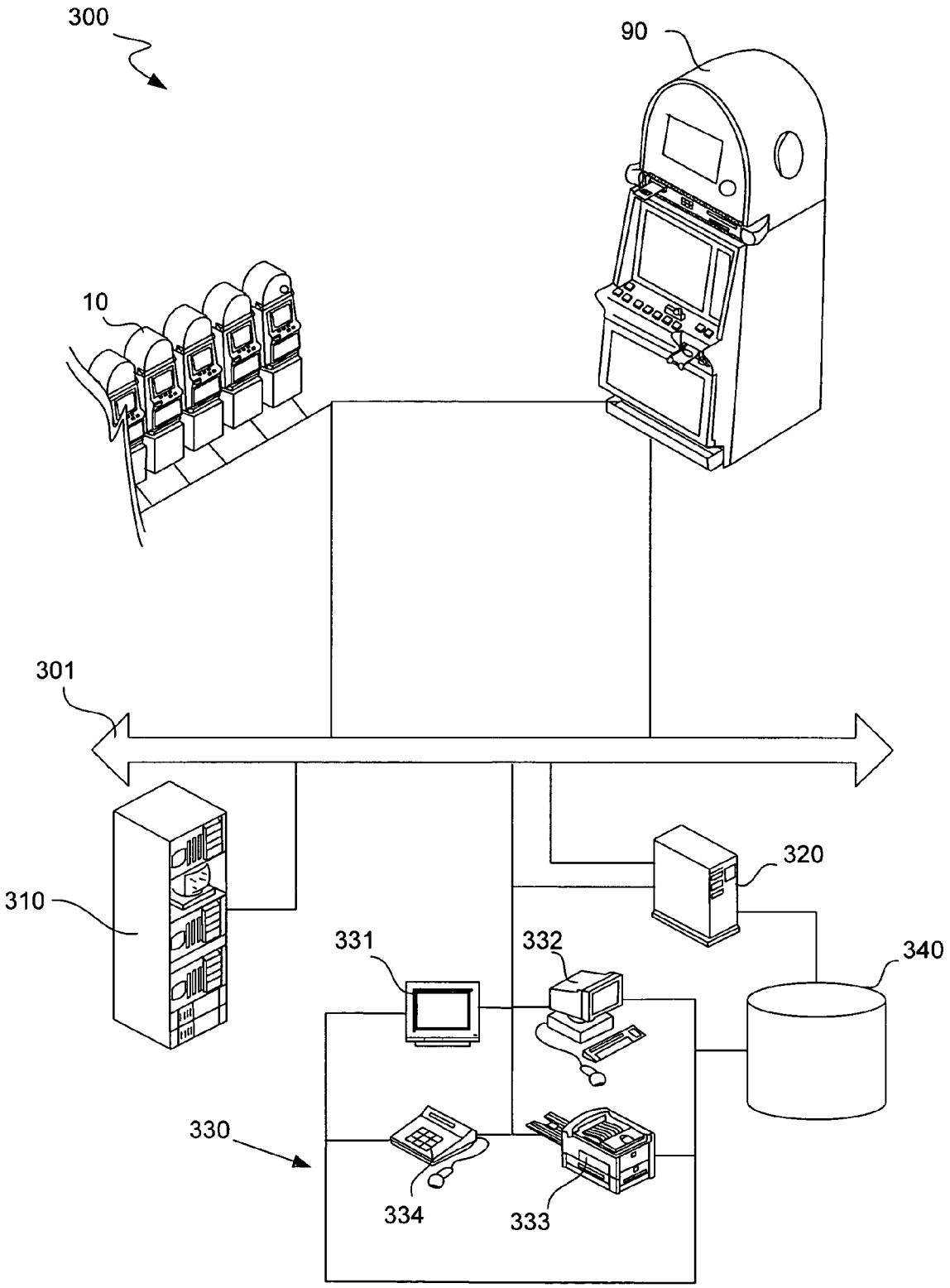
FIG. 7 illustrates in block diagram format an exemplary network infrastructure for providing a gaming system having one or more specialized gaming machines according to one embodiment of the present invention.

Turning lastly to FIG. 7, an exemplary network for providing a gaming system having one or more specialized gaming machines is illustrated in block diagram format. Exemplary gaming system 300 has one or more gaming machines, various communication items, and a number of host-side components and devices adapted for use within a gaming environment. As shown, both one or more ordinary gaming machines 10 and one or more specialized gaming machines 90 adapted for use in gaming system 300 can be in a plurality of locations, such as in banks on a casino floor or standing alone at a smaller non-gaming establishment, as desired. As will be readily appreciated, the one or more specialized gaming machines 90 can be those having configurators or being otherwise adapted to provide gaming operators with the various operator adjustable options, as described above.

Common bus 301 can connect one or more gaming machines or devices to a number of networked devices on the gaming system 300, such as, for example, a general-purpose server 310, one or more special-purpose servers 320, a sub-network of peripheral devices 330, and/or a database 340. A general-purpose server 320 may be one that is already present within a casino or other establishment for one or more other purposes beyond any configuration purposes involving specialized gaming machines. Functions for such a general-purpose server can include other general and game specific accounting functions, payroll functions, general Internet and e-mail capabilities, switchboard communications, and reservations and other hotel and restaurant operations, as well as other assorted general establishment record keeping and operations. In some cases, specific gaming related functions such as cashless gaming, downloadable gaming, player tracking, remote game administration, video or other data transmission, or other types of functions may also be associated with or performed by such a general-purpose server. For example, such a server may contain various programs related to player tracking operations, player account administration, remote game play administration, remote game player verification, downloadable gaming, and/or visual image or video data storage, transfer and distribution, and may also be linked to one or more gaming machines, in some cases forming a network that includes all or many of the gaming devices and/or machines within the establishment. Communications can then be exchanged from each adapted gaming machine to one or more related programs or modules on the general-purpose server.

In one embodiment, gaming system 300 contains one or more special-purpose servers 320 that can be used for various functions relating to the provision of operator adjustable settings and reconfigurable gaming machines and terminals under the present methods and systems. Such a special-purpose server or servers could include, for example, a cashless gaming server, a player verification server, a general game server, a downloadable games server, a specialized accounting server, and/or a visual image or video distribution server, among others, as well as a special purpose configuration server. Of course, these functions may all be combined onto a single server, such as specialized server 320. Such additional special-purpose servers are desirable for a variety of reasons, such as, for example, to lessen the burden on an existing general-purpose server or to isolate or wall off some or all gaming machine administration and operations data and functions from the general-purpose server and thereby increase security and limit the possible modes of access to such operations and information.

Alternatively, exemplary gaming system 300 can be isolated from any other network at the establishment, such that a general-purpose server is essentially impractical and unnecessary. Under either embodiment of an isolated or shared network, one or more of the special-purpose servers are preferably connected to sub-network 330, which might be, for example, a cashier station or terminal, or a control room. Peripheral devices in this sub-network may include, for example, one or more video displays 331, one or more user terminals 332, one or more printers 333, and one or more other input devices 334, such as a card reader or other security identifier, among others. Under either embodiment of an isolated or shared network, at least the specialized server 320 or another similar component within a general-purpose server 310 preferably includes a connection to a database or other suitable storage medium 340. Database 340 can be adapted to store many or all files containing pertinent data or information regarding, for example, automated settings and changes for same according to various dates, times and other events, among other potential items. Files, data and other information on database 340 can be stored for backup purposes, and are preferably accessible at one or more system locations, such as at a general-purpose server 310, a special purpose server 320 and/or a cashier station or other sub-network location 330, as desired.

While gaming system 300 can be a system that is specially designed and created new for use in a casino or gaming establishment, it is also possible that many items in this system can be taken or adopted from an existing gaming system. For example, gaming system 300 could represent an existing gaming system or network to which one or more of the inventive components or program modules are added. In addition to new hardware, new functionality via new software, modules, updates or otherwise can be provided to an existing database 340, specialized server 320 and/or general-purpose server 310, as desired. In this manner, the methods and systems of the present invention may be practiced at reduced costs by gaming operators that already have existing gaming systems, such as, for example, an existing accounting or player tracking system, by simply modifying the existing gaming system. Other modifications to an existing system may also be necessary, as might be appreciated.

Although the foregoing invention has been described in detail by way of illustration and example for purposes of clarity and understanding, it will be recognized that the above described invention may be embodied in numerous other specific variations and embodiments without departing from the spirit or essential characteristics of the invention. Certain changes and modifications may be practiced, and it is understood that the invention is not to be limited by the foregoing details, but rather is to be defined by the scope of the appended claims.

What is claimed is:

1. A method of administering games at a gaming machine or gaming terminal adapted for accepting overall wagers, playing games based on the overall wagers and granting monetary awards based on a plurality of results of the games, the method comprising:

providing a gaming machine or system having at least a master gaming controller and a configurator adapted to facilitate provision of one or more operator adjustable settings to an operator of said gaming machine or system;

adjusting at least one of said one or more operator adjustable settings, wherein said at least one adjusted operator adjustable setting includes at least one of a minimum overall wager, a maximum overall wager, a minimum number of paylines to be played, a denomination, and a payline's wagered incremental value;

offering to a player of said gaming machine or gaming terminal an option to change at least one game parameter, said at least one game parameter including at least one of a denomination to be played, an overall wager amount, a number of paylines to be played, and a wager amount per payline, wherein a limit of said at least one game parameter is defined by the result of said adjusting step;

accepting a first input from said player implementing one or more changes to at least said denomination to be played;

calculating automatically, based on the first input, an appropriate value for each of the remaining game parameters from said at least one game parameter;

receiving a second input from said player regarding initiation of a game play based on said accepted and automatically calculated game parameters;

disabling receipt of a third input from said player which would implement one or more changes to said at least one game parameter after said adjusting said at least one of said one or more operator adjustable settings, wherein the third input is disabled in response to receipt of the first input from said player implementing one or more changes to said denomination to be played and independent of receipt of the second input from said player regarding initiation of game play, wherein the third input is capable of being received from said player before said adjusting said at least one of said one or more operator adjustable settings, and wherein an input device that receives the third input is present at said gaming machine before and after said adjusting said at least one of said one or more operator adjustable settings;

playing a first game based on said accepted and automatically calculated game parameters; and granting a monetary award to said player based on the result of said game.

2. The method of claim 1, further including the steps of:

accepting a fourth input from said player regarding one or more further changes to said at least one game parameter; and recalculating automatically an appropriate value for each of the remaining game parameters based on said fourth input.

* * * * *